US009895858B2

(12) United States Patent
Matsunaga

(10) Patent No.: US 9,895,858 B2
(45) Date of Patent: Feb. 20, 2018

(54) SHEET PROCESSING APPARATUS, METHOD FOR CONTROLLING SHEET PROCESSING APPARATUS, AND STORAGE MEDIUM

(71) Applicant: CANON KABUSHIKI KAISHA, Tokyo (JP)

(72) Inventor: Akira Matsunaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 437 days.

(21) Appl. No.: 14/629,851

(22) Filed: Feb. 24, 2015

(65) Prior Publication Data

US 2015/0239705 A1 Aug. 27, 2015

(30) Foreign Application Priority Data

Feb. 25, 2014 (JP) ..... 2014-034454

(51) Int. Cl.
*B31F 1/08* (2006.01)
*B65H 43/06* (2006.01)
(Continued)

(52) U.S. Cl.
CPC ..... *B31F 1/08* (2013.01); *B65H 37/06* (2013.01); *B65H 43/06* (2013.01); *B65H 45/30* (2013.01);
(Continued)

(58) Field of Classification Search
CPC ..... B31F 1/08; B65H 37/06; B65H 43/06; B65H 45/30; B65H 2511/30;
(Continued)

(56) References Cited

U.S. PATENT DOCUMENTS 7,740,238 B2 * 6/2010 Iijima ..... B42B 4/00 270/32
7,770,876 B2 * 8/2010 Sasahara ..... B31F 1/08 270/20.1

(Continued)

FOREIGN PATENT DOCUMENTS

| | | | |
|---|---|---|---|
| JP | S58-148154 | A | 9/1983 |
| JP | S59-074855 | A | 4/1984 |
| JP | S63-116167 | A | 5/1988 |
| JP | H06-183177 | A | 7/1994 |
| JP | 2007-050691 | A | 3/2007 |

*Primary Examiner* — Leslie A Nicholson, III
(74) *Attorney, Agent, or Firm* — Canon U.S.A., Inc. IP Division

(57) ABSTRACT

A sheet processing apparatus includes a processing unit, a sheet discharge unit, a determination unit, and a control unit. The processing unit performs crease processing on a sheet. The sheet discharge unit discharges a sheet having been subjected to the crease processing by the processing unit. The determination unit determines whether a number of the discharged sheets having been subjected to the crease processing exceeds a predetermined number of sheets. The control unit performs control to cause the discharge unit to discharge a sheet. In a case where the determination unit determines that the number of the discharged sheets having been subjected to the crease processing exceeds the predetermined number of sheets, the control unit performs control to cause the discharge unit to not discharge sheets having been subjected to the crease processing onto the discharge destination.

6 Claims, 12 Drawing Sheets

700 701 702 703

| | MAXIMUM STACKABLE SHEET AMOUNT | WHETHER SHEET IS STACKED | WHETHER CREASE-PROCESSED SHEET IS STACKED |
|---|---|---|---|
| STACK PORTION OF STACKER | 3000 | STACKED | STACKED |
| TRAY OF STACKER | 200 | NOT STACKED | NOT STACKED |
| UPPER TRAY OF FINISHER | 500 | NOT STACKED | NOT STACKED |
| LOWER TRAY OF FINISHER | 1500 | STACKED | NOT STACKED |

(51) Int. Cl.

| | |
|---|---|
| ***B65H 37/06*** | (2006.01) |
| ***B65H 45/30*** | (2006.01) |
| ***G03G 15/00*** | (2006.01) |
| *B65H 31/24* | (2006.01) |

(52) U.S. Cl.
CPC ..... *G03G 15/6582* (2013.01); *B65H 31/24* (2013.01); *B65H 2511/30* (2013.01); *B65H 2801/27* (2013.01); *G03G 15/6573* (2013.01); *G03G 2215/00109* (2013.01); *G03G 2215/00426* (2013.01); *G03G 2215/00603* (2013.01); *G03G 2215/00877* (2013.01)

(58) Field of Classification Search
CPC ..... B65H 2801/27; G03G 15/6582; G03G 2215/00426; G03G 2215/00603; G03G 2215/00877
USPC ..... 270/32, 45, 58.07, 58.08, 58.09; 493/59, 493/240, 242, 355, 396, 397
See application file for complete search history.

(56) References Cited

U.S. PATENT DOCUMENTS

| | | | | |
|---|---|---|---|---|
| 7,992,855 | B2 * | 8/2011 | Awano | G03G 15/6541 270/58.07 |
| 8,561,983 | B2 * | 10/2013 | Takahashi | B65H 43/06 271/207 |
| 2016/0122152 | A1 * | 5/2016 | Schoenmakers | G06F 3/1255 271/207 |

* cited by examiner

FIG. 7

700

| | 701 MAXIMUM STACKABLE SHEET AMOUNT | 702 WHETHER SHEET IS STACKED | 703 WHETHER CREASE-PROCESSED SHEET IS STACKED |
|---|---|---|---|
| STACK PORTION OF STACKER | 3000 | STACKED | STACKED |
| TRAY OF STACKER | 200 | NOT STACKED | NOT STACKED |
| UPPER TRAY OF FINISHER | 500 | NOT STACKED | NOT STACKED |
| LOWER TRAY OF FINISHER | 1500 | STACKED | NOT STACKED |

SHEET PROCESSING APPARATUS, METHOD FOR CONTROLLING SHEET PROCESSING APPARATUS, AND STORAGE MEDIUM

BACKGROUND OF THE INVENTION

Field of the Invention

The present invention relates to a sheet processing apparatus, a method of controlling a sheet processing apparatus, and a storage medium.

Description of the Related Art

In the printing market, a print on demand (POD) using digital printing apparatuses has been becoming popular with recent increasing processing speed and image quality in electrophotographic printing apparatuses and ink-jet printing apparatuses. The POD printing has appeared in place of printing using large-scale printing apparatuses and printing methods so as to handle jobs of relatively small lots in short delivery time periods without using the large-scale apparatuses and systems.

Different from the conventional printing methods in which printing plates are made for printing, in the POD printing, in every printing for each print job, original data is edited and processed, print image data is generated, print appearance is set, and then, print processing is performed in the digital printing apparatuses. To add value to the print products, post-processing on the printed sheets may be performed by a sheet processing apparatus. This series of processing to such a print job is defined as a group of the processes associated with the print job, and called a print work flow in the POD.

In the POD print work flow, typically, a front page, insertion pages, and body pages are printed by a plurality of printing apparatuses, and bookbinding processing of the printed sheets is performed by an off-line sheet processing apparatus. By the off-line sheet processing apparatus, saddle stitch processing is performed to a bundle of sheets, and so-called center folding or center fold binding is performed to fold the saddle-stitch processed sheet bundle. Japanese Patent Application Laid-Open No. 2007-50691 discusses a technique for reducing the workload of operators in such a POD print environment by performing shifts, dividing sheet insertion, and discharge destination change to another stacker every time the number of sheet bundles on a stacker reaches a predetermined number of sheets or a predetermined height.

Meanwhile, in the saddle stitching bookbinding, when a bundle of sheets is folded together, the amounts of elongation of the sheets in the folded portions on the outside of the sheet bundle are larger than those on the inside of the sheets. Consequently, portions of formed images in the folded portions of the sheets of the outside are elongated, and damage such as toner peeling and crack may occur at the portions of the formed images in the folded portions.

To solve such a problem, creasing apparatuses called creasers have been known. The creaser puts a fold (crease) in a folding portion of each sheet in advance prior to the execution of folding processing, for example, folding processing of a bundle of sheets in two, so that the sheets of the outside can be easily folded to prevent toner crack. In such known creasing apparatuses, a creasing blade comes in contact with a sheet to put a fold in the contact portion.

In the above-described POD print work flow, there is a use case in which creasing processing is performed by the creaser after printing is performed on a sheet to be the front page by the printing apparatus, to increase the quality of the saddle stitch bookbinding by the off-line sheet processing apparatus.

On the sheet creased by the crease processing, uneven portions are caused. When the uneven sheets are stacked one after another, the weight of the sheets stacked at the upper part is imposed on the uneven portions of the sheets stacked at the lower part, and thereby the crease portions may be crashed.

For example, in a stacking apparatus, a large amount of printed sheets, e.g., 3000 printed sheets, can be stored. In such an environment, when several thousand sheets are stacked therein, a considerable load is applied to the sheets stacked at a lower part, and the crease portions can be crashed easily.

If the creased portions are crashed, it is difficult to obtain full back crack prevention effect and to achieve maximum effects by the creasing processing.

SUMMARY OF THE INVENTION

According to an aspect of the present invention, a sheet processing apparatus includes a processing unit configured to perform crease processing on a sheet, a sheet discharge unit configured to discharge a sheet having been subjected to the crease processing by the processing unit, a determination unit configured to determine whether a number of the discharged sheets having been subjected to the crease processing exceeds a predetermined number of sheets, and a control unit configured to perform control to cause the discharge unit to discharge a sheet, wherein, in a case where the determination unit determines that the number of the discharged sheets having been subjected to the crease processing exceeds the predetermined number of sheets, the control unit performs control to cause the discharge unit to not discharge sheets having been subjected to the crease processing onto the discharge destination.

Further features of the present invention will become apparent from the following description of exemplary embodiments with reference to the attached drawings.

BRIEF DESCRIPTION OF THE DRAWINGS

FIG. 7 illustrates an example of a sheet processing management table.

DESCRIPTION OF THE EMBODIMENTS

Hereinafter, exemplary embodiments of the present invention will be described with reference to the attached drawings. Note that the following exemplary embodiments is not intended to limit the present invention according to the scope of the claims, and not all combinations of features described in the embodiments are necessary for means for solving the problems in the present invention.

<Description of System Configuration>

Figure 1A:
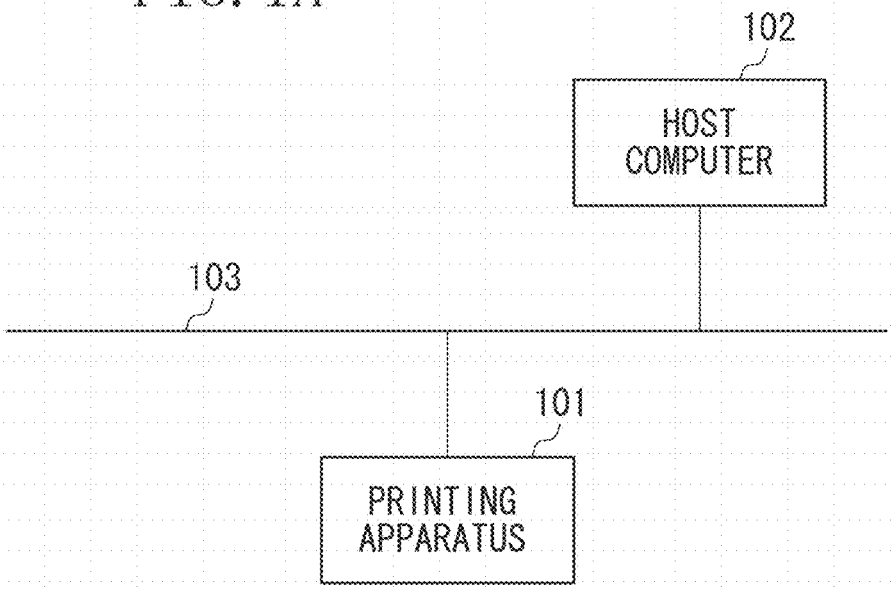
FIGS. 1A and 1B are block diagrams illustrating examples of configurations of a print system to which a printing apparatus can be applied.
Figure 1B:
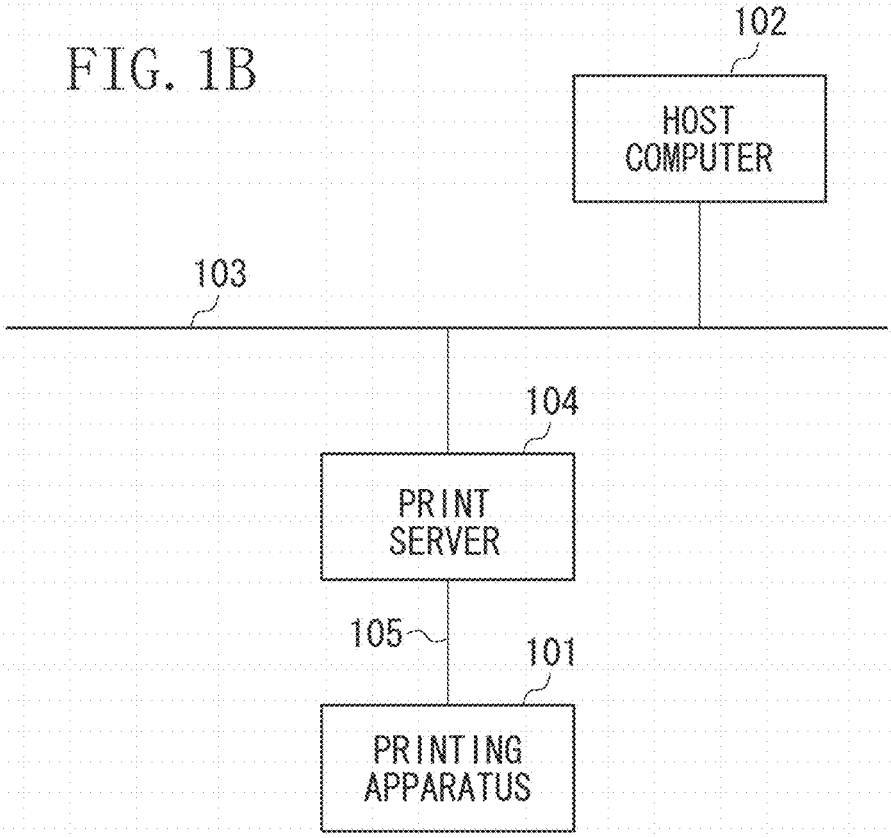

FIGS. 1A and 1B are block diagrams illustrating examples of configurations of a print system to which a printing apparatus according to the first exemplary embodiment can be applied.

In FIG. 1A, a printing apparatus 101 and a host computer 102 are connected via a network 103. The printing apparatus 101 forms an image on a recording sheet, and is also called an image forming apparatus.

Hereinbelow, with respect to the printing apparatus according to the exemplary embodiment of the present invention, an example of a multifunction peripheral (MFP) that includes functions in addition to the print function, for example, a scanning function, a facsimile reception function, and a file server function, is described. The printing apparatus can be a printer that has only the print function, or an apparatus that has a function other than the above-described functions.

In FIGS. 1A and 1B, the host computer 102 is a personal computer (PC) that is used by an operator of the printing apparatus, or general users. An application operating on the host computer 102 generates image data. A printer driver operating on the host computer 102 sends data (print job) including print settings and image data as a group to the printing apparatus 101 via the network 103. The printing apparatus 101 interprets the received print job, and performs image processing and other processing. Then, the printing apparatus 101 performs printing on a sheet, and finishing processing.

The print system illustrated in FIG. 1B differs from the print system illustrated in FIG. 1A in that a print server 104 is connected between the printing apparatus 101 and the network 103.

In FIG. 1B, the print server 104 once receives a print job from the host computer 102, and performs image processing and other processing. In response to the completion of the processing, the print server 104 sends the print job to the printing apparatus 101 that is directly connected via a local network 105.

The job can be directly sent to the printing apparatus 101 without an instruction of the user in response to the completion of the image processing and other processing. Alternatively, the job can be temporarily held in the print server 104 at the time when the image processing and other processing are completed, and can be sent to the printing apparatus 101 at the timing at which the operator wants to print it. From the side of the host computer 102, it looks as if the printing apparatus 101 and the print server 104 are an integrated printing system.

Figure 2:
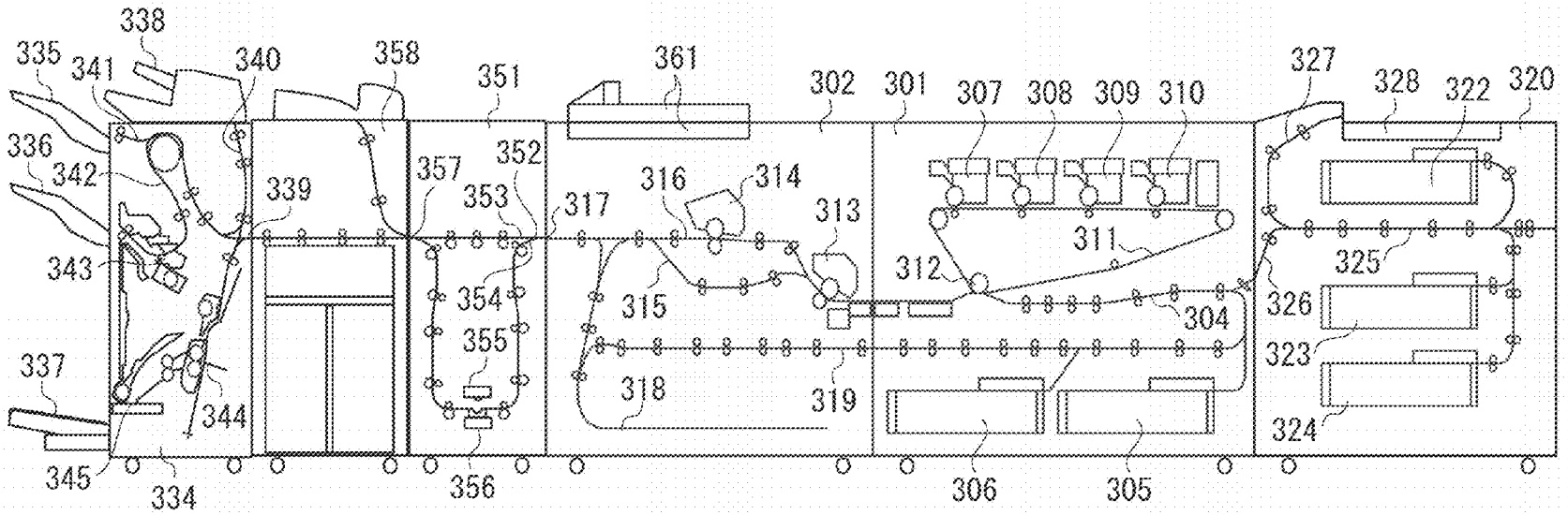
FIG. 2 is a cross-sectional view illustrating a structure of a printing apparatus and a sheet processing apparatus.

FIG. 2 is a cross-sectional view illustrating a structure of a printing apparatus and a sheet processing apparatus that can be applied to the printing system illustrated in FIGS. 1A and 1B. In the present exemplary embodiment, to the printing apparatus 101, a sheet feeding accessory apparatus, a sheet processing apparatus for sheet post-processing, and other apparatuses are connected in line.

In FIG. 2, there are provided an image forming apparatus (main body) 301 and an image fixing apparatus 302. The main body 301 and the image fixing apparatus 302 cooperatively perform image formation onto paper (sheet). As a sheet feeding apparatus, a large-capacity sheet feeding deck 320 is connected to the right side of the main body 301. Although not illustrated in this configuration, a plurality of the sheet feeding decks can be connected thereto. As a sheet processing apparatus, a creaser 351 is connected to the left side of the image fixing apparatus 302. The creaser 351 is a post-processing apparatus for giving a crease in a portion to be folded in advance. A control method for controlling the sheet processing apparatus, which is a most characteristic part of the present invention, relates to the control of the creaser 351. In addition to the creaser, a stacker apparatus 358 and a finisher 334 are connected to the left side thereof.

Figure 3:
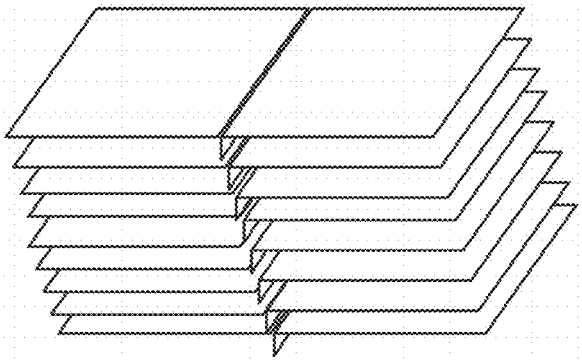
FIG. 3 is a perspective view illustrating a state of a bundle of sheets having been subjected to post-processing by a creaser.

FIG. 3 is a perspective view illustrating a state of a bundle of sheets to which post-processing has been performed by the creaser 351 illustrated in FIG. 2.

In FIG. 2, sheet feed decks 305 and 306 operate as standard sheet feed units. Developing units 307 to 310 include four stations of Y, M, C, and K to form color images. The images formed by the units are primarily transferred onto an intermediate transfer belt 311. Then, the intermediate transfer belt rotates in the clockwise direction in FIG. 2, and the images are transferred onto a sheet conveyed from a sheet conveyance path 304 at a secondary transfer position 312.

The sheet on which the images are transferred is conveyed from the main body 301 to the image fixing apparatus 302, and heated and pressed by a fixing device 313 in the image fixing apparatus 302 to fix the images onto the sheet. The sheet passed through the fixing device 313 is conveyed to a position 317 via a conveyance path 315.

Depending on the type of the sheet, if additional heating and pressing is necessary for fixation, after the sheet has passed through the fixing device 313, the sheet is conveyed to a second fixing device 314 using the above-mentioned conveyance path, and additional heating and pressing is performed. Then, the sheet is conveyed to the position 317 through a conveyance path 316.

If the image formation mode is set to a two-sided mode, the sheet is conveyed to a sheet reversing path 318, and reversed in the sheet reversing path 318. Then, the sheet is conveyed to a two-sided conveyance path 319, re-feeding of the sheet is performed, and image formation onto the second side of the two sides is performed again at the secondary transfer position 312.

Other than the standard sheet feeding units of the image forming apparatus, sheets can be fed from three sheet feeding decks 322, 323, and 324 of the large-capacity sheet feeding deck 320. The fed sheet is conveyed to the main body 301 through sheet conveyance paths 315 and 326, and image formation is performed. The large-capacity sheet feeding deck 320 includes a function for detecting multifeed, which is a state where a plurality of sheets are overlapped and conveyed in such an overlapped state. When the multifeed is detected, the sheet conveyance path is switched from the regular sheet conveyance path 326 to a sheet conveyance path 327 to discharge the sheet onto an escape tray 328.

Next, the creaser 351 in the sheet processing apparatus is described.

The creaser 351 is a sheet processing apparatus for giving a crease in a predetermined place of a sheet. An image-formation completed sheet is sent from the image fixing apparatus 302 via the position 317 to a sheet conveyance portion of the creaser. If an instruction to crease the sheet to be conveyed has been issued, the sheet is conveyed from a sheet conveyance path 352 through a sheet conveyance path 354, and nipped by a convex crease die 355 and a concave crease die 356 so that the sheet is creased. Depending on the grammage and the type of the sheet, the convex crease die 355 and the concave crease die 356 can be changed, and in such a case, the user sets a die optimum for each case. After the completion of the crease processing, through the sheet conveyance path 357, the sheet is conveyed to a next post-processing apparatus. If an instruction to perform the crease processing is not issued, the sheet is conveyed from the sheet conveyance path 352 through a sheet conveyance path 353 to the sheet conveyance path 357.

If the sheet is to be conveyed further to a sheet processing apparatus of the latter stage of the creaser 351, the sheet is conveyed through the sheet conveyance path 357 to the stacker apparatus 358 and the finisher 334.

Next, the stacker apparatus 358 is described.

The stacker apparatus 358 includes three conveyance paths of a straight path, an escape path, and a stack path. The stacker apparatus 358 also includes a stacking portion that can store a large number of sheets. On the stacking portion, for example, about 3000 sheets can be stacked. The straight path is used to convey the sheet received from the apparatus of the previous stage to the apparatus of the subsequent stage, and can also be called a through path in the in-line sheet processing apparatus.

The escape path is used to discharge the sheet without stacking the sheet on the stacking portion. For example, if no subsequent sheet processing apparatus is connected, and an output check operation (proof print) is to be performed, the print product is conveyed to the escape path, and discharged via the escape path to a discharge tray for pickup. On the sheet conveyance path of the large-capacity stacker, a plurality of sheet sensors necessary to detect a sheet conveyance status and a jam is provided. To the stacking portion, a sheet sensor for detecting an amount of stacked sheets is provided.

Next, the finisher 334 is described.

The finisher 334 performs post-processing on printed sheets according to a function specified by the user. More specifically, the finisher 334 has a stapling function (binding at a point or two points), a punching function (two holes or three holes), a function of a saddle stitching binding, and other functions. The finisher 334 includes two discharge trays of a discharge tray 335 and a discharge tray 336. A sheet is output onto the discharge tray 335 via a sheet conveyance path 341. Through the sheet conveyance path 341, processing such as stapling cannot be performed. If the processing such as stapling is to be performed, finishing according to a function specified by the user is performed in a finisher 343 via a sheet conveyance path 342, and the sheet is output onto the discharge tray 336.

Both of the discharge trays 335 and 336 can move up and down in the vertical direction. The discharge tray 335 can be moved down to stack sheets having been subjected to finishing-processed by the finisher 343, from a lower discharge port.

Each of the discharge trays 335 and 336 has a sheet sensor for detecting whether a sheet is stacked or not. If insertion paper is specified by the user, the insertion paper that has been set on an inserter 338 can be inserted into a predetermined page via a sheet conveyance path 340.

If saddle stitching binding is specified to a print job, in a saddle stitching processing unit 344, the sheets are stapled at the center of the sheets, folded in two, and then, output onto a saddle stitching binding tray 337 via a sheet conveyance path 345. The saddle stitching binding tray 337 has a conveyor belt structure, and the saddle-stitching-binding processed bundle stacked on the saddle stitching binding tray 337 is conveyed to the left side.

A scanner 361 and a document feeder are briefly described.

The scanner 361 and the document feeder are mainly used in a copy function. To set a document on a document positioning plate and perform reading processing, the user sets the document on the document positioning plate and closes the document feeder. Then, an open-close sensor detects that the document positioning plate is closed, and a reflective document size detection sensor provided in the case of the scanner detects the size of the set document. In response to the size detection, the document is irradiated with light from a light source, and an image is read by a charge coupled device (CCD) sensor, and converted into a digital signal. Then, necessary image processing is performed on the signal, and the signal is converted into a laser recording signal. The converted recording signal is stored in a random access memory (RAM) in a controller, which will be described below with reference to FIG. 4.

To set a document on the document feeder and perform reading processing, the user places the document onto a document setting portion of the document feeder in a face-up state. Then, a document presence sensor detects that the document has been set. In response to the detection, a document feed roller and a conveyance belt rotate to convey the document, and the document is set to a predetermined position on the document positioning plate. In the following processing, the image is read similarly to the reading on the document positioning plate, and the read image is stored in the memory in the controller.

Figure 4:
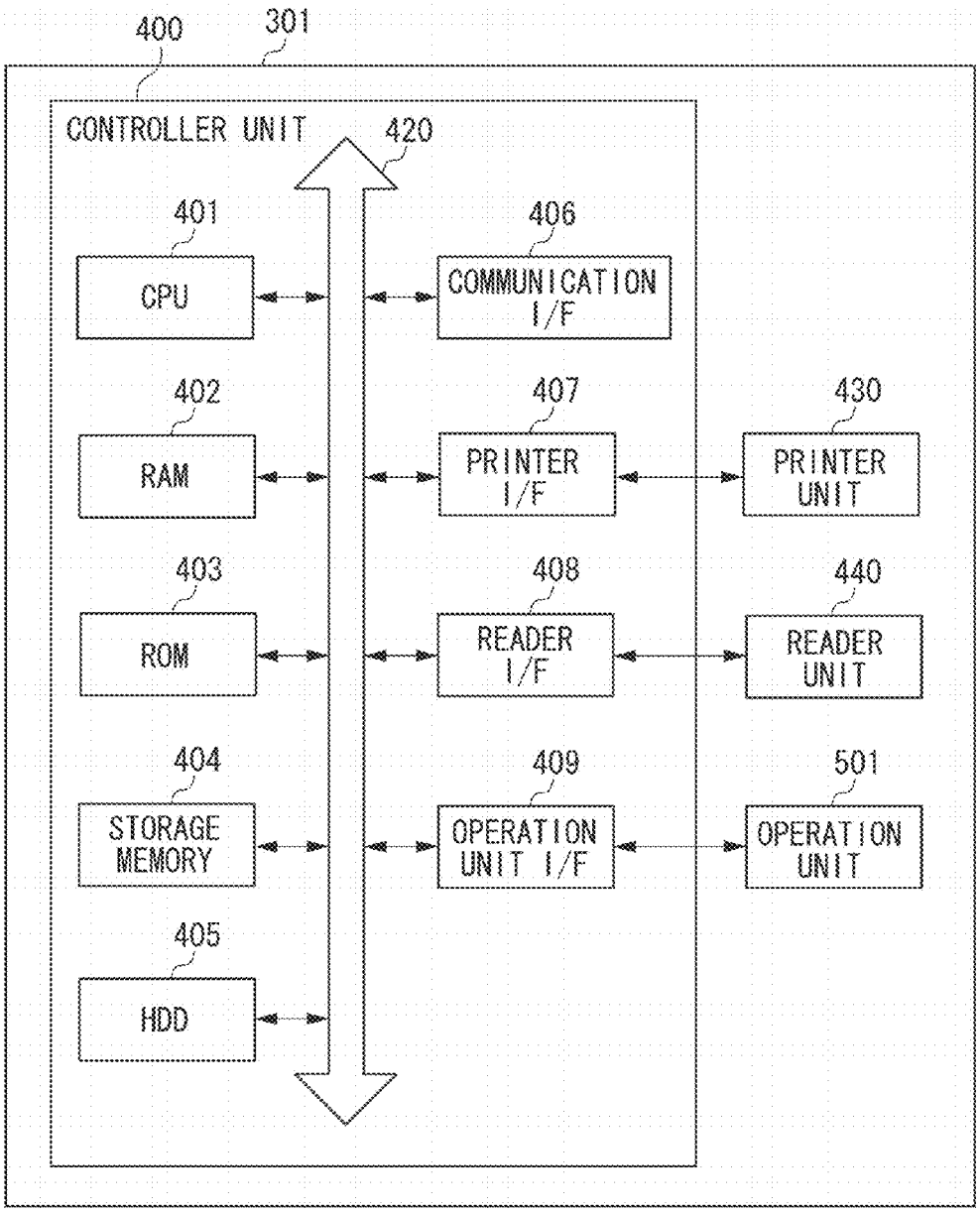
FIG. 4 is a block diagram illustrating a configuration of a controller unit.

FIG. 4 is a block diagram illustrating a structure of a controller unit 400 for performing control of the image forming apparatus 301 illustrated in FIG. 2.

In FIG. 4, each component in the controller unit 400 is connected to a system bus 420. A read-only memory (ROM) 403 stores a basic input/output system (BIOS), an operating system (OS), and a control program for the image forming apparatus 301. A central processing unit (CPU) 401 executes these programs to perform overall control of the whole apparatus.

A RAM 402 is used as a work memory area for executing the programs, and an image memory area for temporarily storing image data. As the RAM 402, a dynamic random access memory (DRAM) is mainly used. A storage memory 404 is a nonvolatile memory. The storage memory 404 stores various types of data to be stored even after turning off the power of the image forming apparatus 301. The storage memory 404 stores information, for example, apparatus setting values, operation logs, error logs, and alarm logs.

A hard disk drive (HDD) 405 is an external storage device. The HDD 405 is used to store a large amount of data such as page description language (PDL) font data and image data of print jobs. A communication interface (I/F) 406 is used to perform data communication between the image forming apparatus 301 and an external device via a network. The communication I/F 406 performs communication control of the data communication.

For example, it is assumed that the communication I/F 406 performs communication control using Transmission Control Protocol/Internet Protocol (TCP/IP). A printer I/F 407 is an interface unit for performing drive control of a printer unit 430. A reader I/F 408 is an interface unit for performing drive control of a reader unit 440. An operation unit I/F 409 is an interface unit for performing display operation control of the controller unit 400 and an operation unit 501. A signal input via a touch panel or hard keys on the operation unit 501 is sent to the CPU 401 via the operation unit I/F 409.

Figure 5:
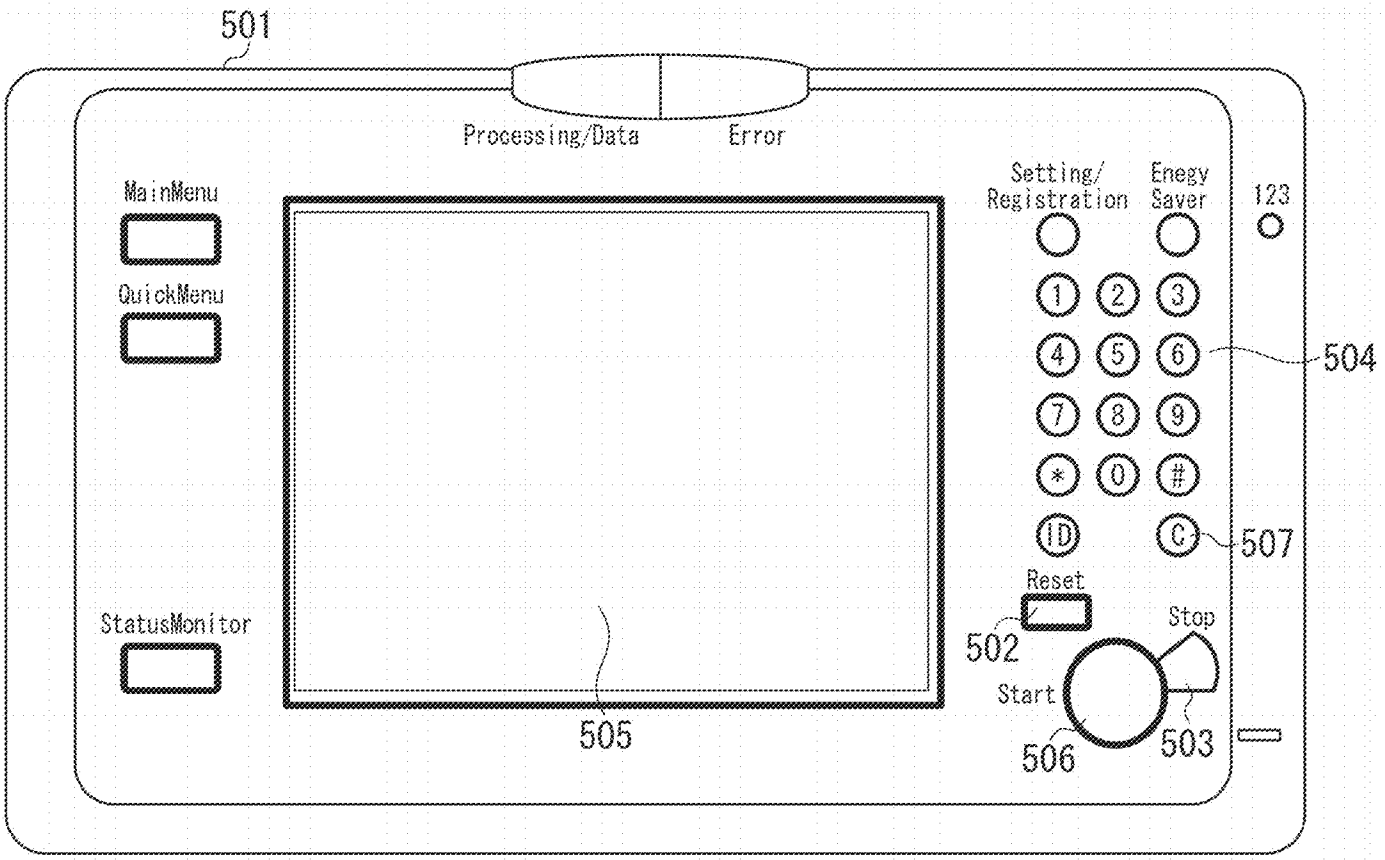
FIG. 5 is a plan view illustrating a structure of an operation unit.

FIG. 5 is a plan view illustrating a structure of the operation unit 501 illustrated in FIG. 4. The operation unit 501 includes a liquid crystal display unit, a touch panel input device attached on the liquid crystal display unit, and a plurality of hard keys.

In FIG. 5, a reset key 502 is used to cancel a setting value set by the user. A stop key 503 is used to stop a job which is in operation. A numerical keypad 504 is used to input a numerical value such as a substituted number. An operation screen 505 is a touch panel type operation screen. A start key 506 is used to start a job such as reading of a document. A clear key 507 is used to clear settings. Moreover, hard keys such as an initial setting/registration button, a power-saving button, a button for displaying a main menu, a quick button for each user to create a customized screen, and a button for a status monitor for displaying a status of the apparatus are provided.

<First Sheet Processing>

Figure 6:
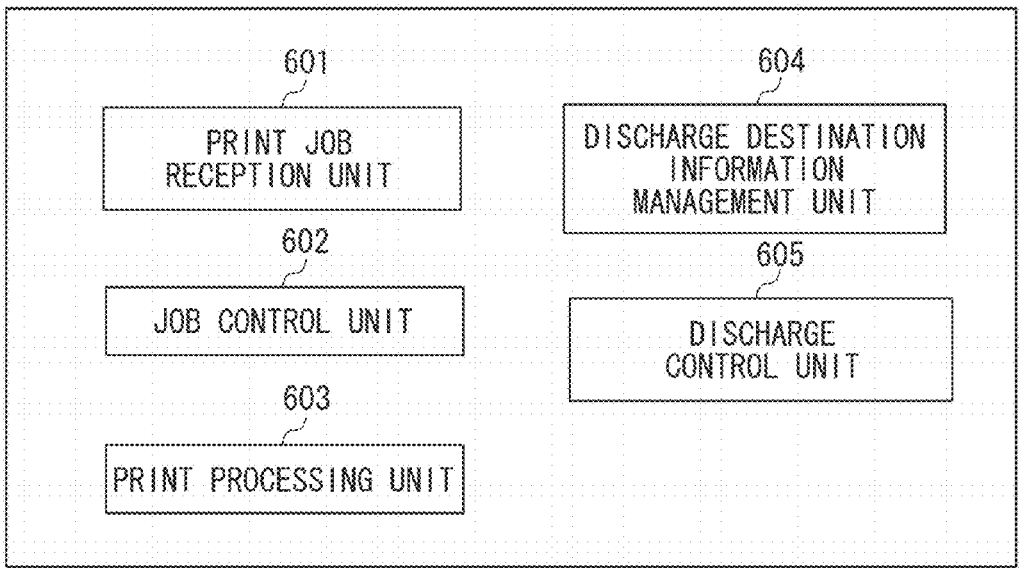
FIG. 6 illustrates a configuration of a control program to be executed by a central processing unit (CPU).
Figure 8:
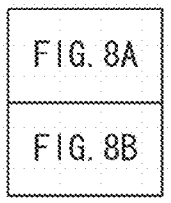
FIG. 8 (consisting of FIGS. 8A and 8B) is a flowchart illustrating a control method of a printing apparatus.

Referring to FIGS. 6 to 8, sheet discharge control relating to a print job in the image forming apparatus 301 according to the first exemplary embodiment of the present invention is described. In the present exemplary embodiment, as a method of limiting stacking onto crease-processed sheets, a sheet discharge destination can be changed.

FIG. 6 illustrates a configuration of a control program to be executed by the CPU 401 in the image forming apparatus 301.

In FIG. 6, a print job reception unit 601 is a module for receiving a print job from an external host computer or the like via the communication I/F 406, and performing data reception processing. When a print job is normally received, the print job reception unit 601 issues a job generation instruction to the job control unit 602.

The job control unit 602 performs job scheduling in simultaneously executing a plurality of jobs, for example, a copy job and scan job, in addition to the print job. The received jobs are stored in a job queue in this processing, and sent to a print processing unit 603 at a timing of a processing order.

The print processing unit 603 processes print data and generate a rasterized image. The print processing unit 603 outputs a control signal to the printer unit 430 via the printer I/F 407 to perform printing onto recording paper, finishing processing in each apparatus in the downstream of the image forming apparatus 301, or the like.

The print processing unit 603 is configured to enable, for each job, specification of ON/OFF setting (crease setting) for performing the crease processing to the job. A discharge destination information management unit 604 stores, as a management table 700, information about discharge destinations to which sheets can be discharged from the image forming apparatus 301.

FIG. 7 illustrates an example of the sheet processing management table managed by the discharge destination information management unit 604 illustrated in FIG. 6.

In FIG. 7, in the present exemplary embodiment, the discharge destination information management unit 604 can refer to the information in a maximum stackable sheet amount 701 of a discharge destination, an item 702 indicating whether a sheet is stacked, and an item 703 indicating whether a crease-processed sheet is stacked to manage sheet processing. Hereinafter, the contents of the flags of the individual information are described in detail.

The maximum stackable sheet amount 701 indicates a maximum number of sheets stackable on the discharge destination. A value provided as an apparatus-specific value is read into this information. The item 702 indicating whether a sheet is stacked is a flag indicating whether at least one sheet is stacked on the discharge destination. The item 702 reflects, for example, a result from a stack detection sensor provided to each discharge destination.

The item 703 indicating whether a crease-processed sheet is stacked is a flag indicating whether there is a crease-processed sheet in the sheets stacked on the discharge destination. The management table 700 is stored, for example, in a memory area on the RAM 402. The management table 700 is information usable while the power supply to the image forming apparatus 301 is turned on. The discharge destination information management unit provides an I/F for acquiring/changing the management table 700, and when the management table 700 is updated, issues an update notification to each module such as a discharge control unit 605, which will be described below.

The discharge control unit 605 is called when discharge of recording paper is required in executing the print processing unit 603. The sheet discharge control unit 605 determines and controls a discharge destination of a recording paper based on the information obtained from the discharge destination information management unit and settings of the print job. The discharge control unit 605 manages, as a threshold value of an allowable number of stacking sheets having subjected to the crease processing, a stack limit amount in crease processing. The value is stored as an apparatus-specific value, for example, in the ROM 403.

Figure 8A:
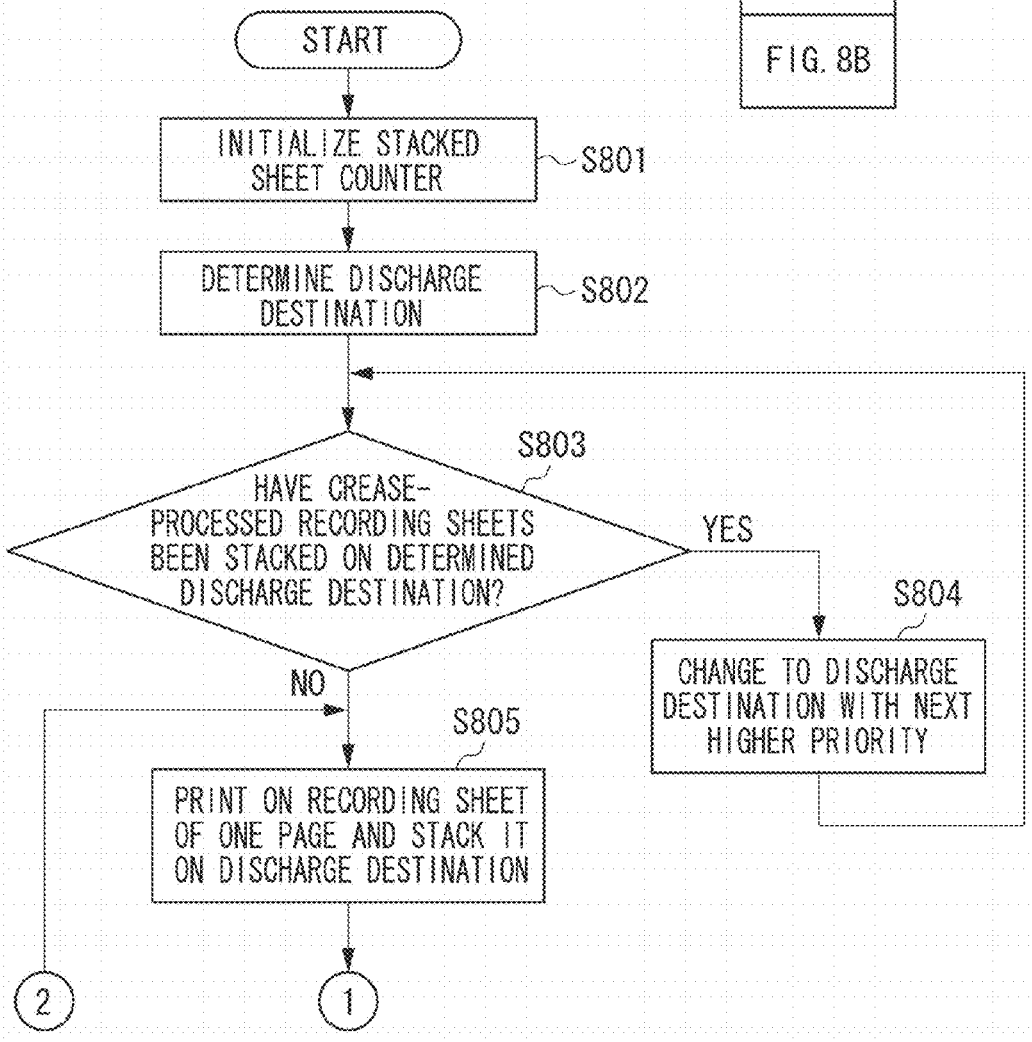
Figure 8B:
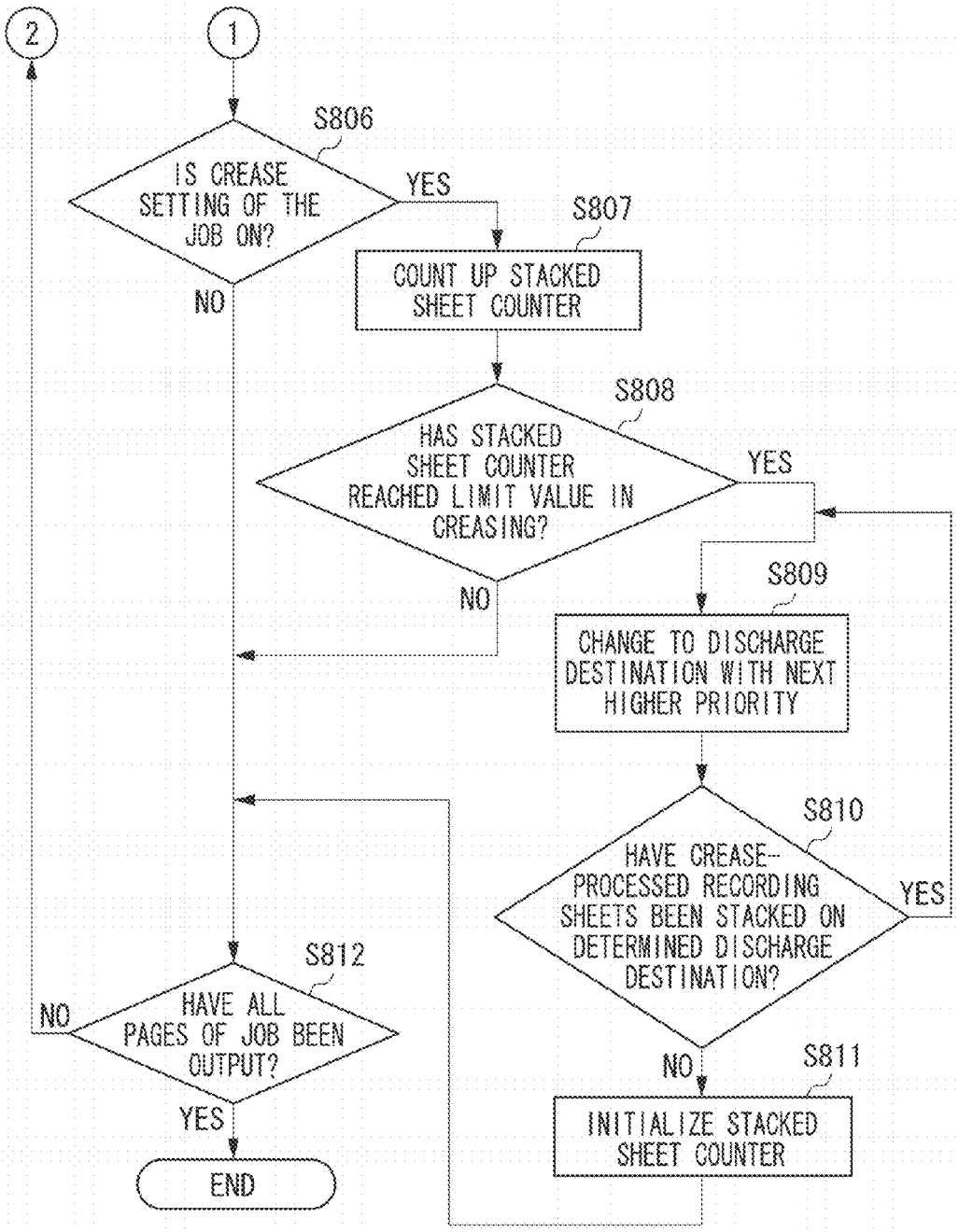

FIG. 8 (consisting of FIGS. 8A and 8B) is an example of a flowchart illustrating a method for controlling the printing apparatus according to the present exemplary embodiment. This example is an example of the sheet discharge control including sheet processing in the printing apparatus. Each step illustrated in FIG. 8 is implemented by the CPU 401 illustrated in FIG. 4 by reading the control program stored in the ROM 403 into the RAM 402 and executing the program. In the description below, the modules illustrated in FIG. 6 are used as main constituents.

In step S801, after the start of a print job, the discharge control unit 605 prepares a stacked sheet counter, and initialize the stacked sheet counter to "zero". In the present exemplary embodiment, the stacked sheet counter is a variable area prepared, for example, in the RAM 402, and operable while the job is being processed. The stacked sheet counter indicates the number of output sheets (the number of discharged sheets).

In step S802, the discharge control unit 605 determines a discharge destination of the recording paper relating to the print job. In the present exemplary embodiment, it is assumed that the discharge destination specification for the print job is "automatically" performed. An optimum discharge destination in this case is selected according to an order of priority preset in the image forming apparatus 301, in consideration of the tray full state of the discharge destination and the finishing specification of the print job.

In step S803, the discharge control unit 605 checks whether a crease-processed output product has been stacked on the discharge destination. This determination is made by reading the management table 700 of the discharge destination information management unit 604, and by checking whether the item 703 indicating whether a crease-processed sheet is stacked is "stacked" or not. If the discharge control unit 605 determines that a crease-processed sheet has been stacked on the discharge destination (YES in step S803), then in step S804, the discharge control unit 605 changes the discharge destination to a discharge destination with a next higher priority. With this step, sheet discharge to a discharge destination on which sheets relating to a crease-processed job have been stacked prior to the job can be limited, and it can be prevented that the creased portions are crashed due to a large number of sheets to be stacked generated by the next job and subsequent jobs.

If the discharge control unit 605 determines that a crease-processed sheet has not been stacked on the discharge destination (NO in step S803), then in step S805, the print processing unit 603 performs printing onto the recording sheet of a one page. In this step, the print processing unit 603 determines whether the settings of the print job include a setting for turning on the crease processing. If the print processing unit 603 determines that the settings of the print job include a setting for turning on the crease processing, the print processing unit 603 outputs a crease processing instruction signal to the creaser 351. The creaser 351 receives the signal, and performs crease processing onto the recording sheet, and thereby a convex portion and a concave portion by crease processing are formed on the recording sheet.

On the other hand, if a setting for turning on the crease processing is not included, the creaser 351 does not perform crease processing, and simply conveys the recording sheet to the apparatus in the downstream direction. Then, the recording sheet is conveyed to a predetermined discharge destination, and stacked.

In response to the stack of the recording sheet of one page, in step S806, the discharge control unit 605 determines whether a specification of turning on crease processing has been made to the job. If the discharge control unit 605 determines that a specification of turning on crease processing has been made (YES in step S806), then in step S807, the discharge control unit 605 counts up the stacked sheet counter.

Then, in step S808, the discharge control unit 605 reads the value of the stacked sheet counter and the value of a stack limit amount in crease processing. The discharge control unit 605 compares these values, and determines whether the value of the stacked sheet counter has reached the stack limit amount in crease processing. As a result of the comparison, if the discharge control unit 605 determines that the value of the stacked sheet counter has reached the stack limit in the crease processing (YES in step S808), then in step S809, the discharge control unit 605 changes the discharge destination to a discharge destination with a next higher priority.

In step S810, the discharge control unit 605 checks whether a crease-processed sheet has been stacked on the discharge destination. The determination processing is similar to that in step S803.

If the discharge control unit 605 determines that a crease-processed sheet has been stacked on the changed discharge destination (YES in step S810), the processing returns to step S809.

In step S810, if the discharge control unit 605 determines that a crease-processed sheet has not been stacked on the changed discharge destination (NO in step S810), then in step S811, the discharge control unit 605 initializes the stacked sheet counter to "zero", and prepares for newly starting counting to the changed discharge destination.

In step S808, if the discharge control unit 605 determines that the stacked sheet amount has not reached the stack limit amount in crease processing (NO in step S808), the processing proceeds to step S812.

In step S812, the discharge control unit 605 determines whether the processing of all pages of the job has been completed. If the discharge control unit 605 determines that there is a subsequent page (NO in step S812), the processing returns to step S805, and the processing is repeated. If the discharge control unit 605 determines that the processing of all pages of the job has been completed (YES in step S812), this flow ends.

As described above, in the present exemplary embodiment, at a time when a stacked amount of the stacked recording sheets has reached a limit amount in crease processing, a discharge destination is changed to another discharge destination. This prevents the creased portions by the creasing processing from being crashed due to a large number of stacked sheets without operator's special attention.

In the present exemplary embodiment, for a job that has been specified to turn on the crease processing, the determination whether a stacked amount of stacked recording sheets has reached a stack limit amount in crease processing is always performed, however, it is not limited to this example. It is known that in jobs specified to turn on the crease processing, depending on the attribute information (for example, the grammage of the sheet and the type of the sheet) of sheets, the states of creases vary.

In consideration of this fact, the determination in step S806 can be performed based on conditions that "a job of crease specification ON and it is determined that a stack limitation is to be made based on attribute information of the sheet". Specifically, depending on the sheet characteristics of recording sheets, there are sheets that easily cause crash in creased portions, and there are sheets that hardly cause crash in creased portions.

Therefore, the stack limitation is to be performed only for the sheets other than the sheets that hardly cause crash in creased portions. For example, sheets of the type to which creased portions can be made strongly enough are the type of the sheets that hardly cause crash in the creased portions, and to such sheets, it is not necessary to set the stack limitation. In a control program in this case, a correspondence table having the attribute information of the sheets and the information whether to perform the stack limitation in the crease processing can be provided in the discharge control unit 605, and in the determination performed in step S806, the values can be referred to.

In the present exemplary embodiment, the stack limit amount in crease processing is an apparatus-specific value. Alternatively, for each print job, a value may be dynamically determined based on the attribute information (for example, the grammage of the sheet and the type of the sheet) of the sheet for the print job. For example, if the grammage of a recording sheet is a predetermined value or more, the stack limit amount in crease processing may be determined to be 2000 sheets, and if the grammage is less than the predetermined value, the stack limit amount in crease processing may be determined to be 1500 sheets.

In such a case, the discharge control unit 605 is to have a correspondence table of media information and limit amounts. Alternatively, the stack limit amount in crease processing can be dynamically determined for each print job based on the strength of the crease of the creaser.

Some known creasers can specify the strength of creases in detail, and by this specification, the strength of a crease to be given to fibers of the paper can vary. Therefore, it may be effective to vary the stack limit amount in crease processing depending on the crease strength of the creaser. For example, in a case of having a lowest crease strength, the stack limit amount in crease processing may be determined to be 1500 sheets, and in a case of having a highest crease strength, the stack limit amount in crease processing may be determined to be 2000 sheets. In such a case, the discharge control unit 605 is to have a correspondence table of crease strength and limit amounts.

Alternatively, a value may be set to the stack limit amount in crease processing by the operator. In such a case, the operation unit 501 includes a setting screen for the stack limit amount in crease processing (not illustrated), and in response to reception of input of a numeric value of the operator, the value is stored, for example, in the storage memory 404. This function is implemented by the discharge control unit 605 by reading the stack limit amount in crease processing from the storage memory 404 as necessary.

A sheet discharge control relating to a print job in the image forming apparatus 301 according to a second exemplary embodiment is described. In the first exemplary embodiment, as a method for limiting stacking onto crease-processed sheets, a sheet discharge destination is changed. In the present exemplary embodiment, a warning message is displayed to temporarily stop printing operation.

Figure 9:
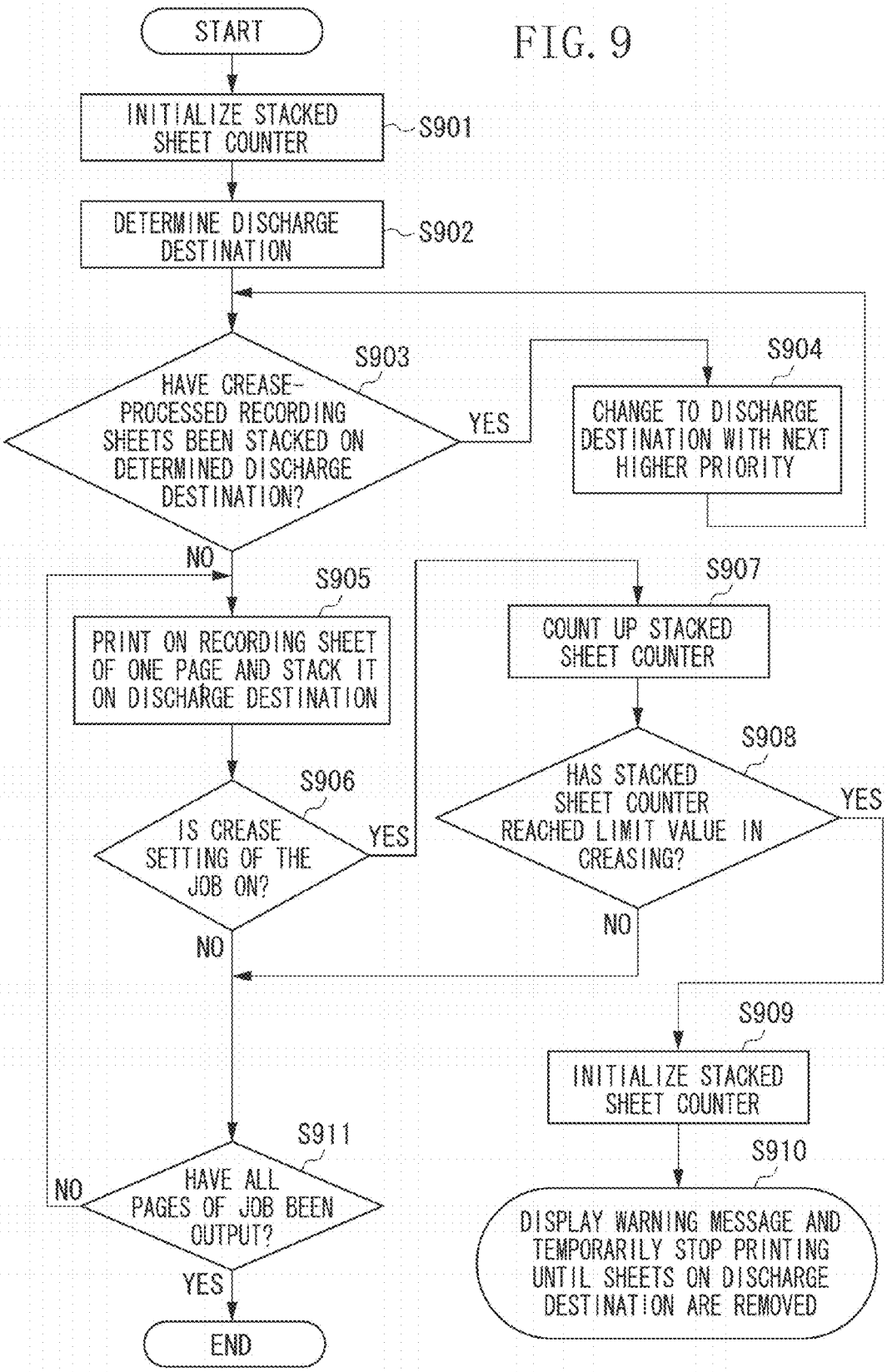
FIG. 9 is a flowchart illustrating a control method of a printing apparatus.

FIG. 9 is a flowchart illustrating a method for controlling the printing apparatus according to the present exemplary embodiment. This example is an example of the sheet discharge control including sheet processing in the printing apparatus. Each step illustrated in FIG. 8 is implemented by the CPU 401 illustrated in FIG. 4 by reading the control program stored in the ROM 403 into the RAM 402 and executing the program. In the description below, the modules illustrated in FIG. 6 are used as main constituents. Steps S901 to S904 in FIG. 9 are similar to those in the first exemplary embodiment, and their detailed descriptions are omitted.

In step S905, the print processing apparatus 603 performs printing onto recording paper of a one page. In response to the stack of the recording sheet of one page, in step S906, the discharge control unit 605 determines whether a specification of turning on the crease processing has been made to the job. If the discharge control unit 605 determines that a specification of turning on the crease processing has been made (YES in step S906), then in step S907, the discharge control unit 605 counts up the stacked sheet counter.

Then, in step S908, the discharge control unit 605 reads the value of the stacked sheet counter and the value of a stack limit amount in crease processing. The discharge control unit 605 compares the values, and determines whether the value of the stacked sheet counter has reached the stack limit amount in the crease processing. As a result of the comparison, if the discharge control unit 605 determines that the value of the stacked sheet counter has reached the stack limit amount in the crease processing (YES in step S908), then in step S909, the discharge control unit 605 initializes the stacked sheet counter to "zero". In step S910, the discharge control unit 605 displays a warning message, an example of which is illustrated in FIG. 10, on the operation unit 501, and temporarily stops the output of the job.

Figure 10:
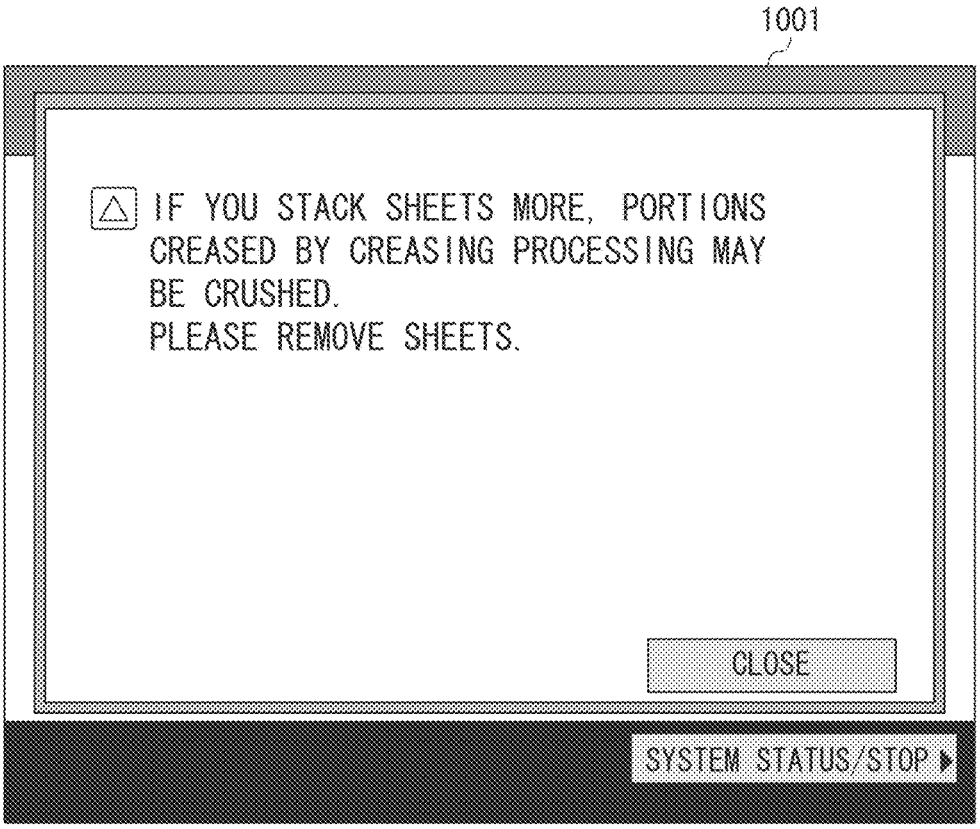
FIG. 10 is a plan view illustrating an example of display of a warning massage to be displayed on an operation screen.

FIG. 10 is a plan view illustrating an example of the display of the warning massage to be displayed on the operation screen illustrated in FIG. 5.

FIG. 10 illustrates an example of a notification of sheet collection to the operator on a warning message screen 1001.

After the operator checks the display screen, although not illustrated, when the operator removes the sheets stacked on the discharge destination, a stack detection sensor of the discharge destination detects it, and the management table 700 is updated.

More specifically, both of the item 702 indicating whether a sheet is stacked on the discharge destination, and the item 703 indicating whether a crease-processed sheet is stacked are changed to "not stacked", and a notification that an update has been made is sent to the discharge control unit 605. If the discharge control unit 605 receives the update notification of the management table 700, the discharge control unit 605 checks whether the item indicating whether a sheet is stacked on the discharge destination has been changed to "not stacked". If the item 702 indicates "not stacked", the processing is resumed from the step S911, and if the item 702 is "stacked", the processing is temporarily stopped until the management table 700 is updated again.

If the stacked amount has not reached the stack limit amount in crease processing (NO in step S908), the processing continues. In step S911, the discharge control unit 605 determines whether processing of all pages of the job has been completed. If the discharge control unit 605 determines that there is a subsequent page (NO in step S911), the processing returns to step S905, and the processing is repeated. If the processing of all pages has been completed (YES in step S911), this flow ends.

As described above, in the present exemplary embodiment, at a time when a stacked amount of the stacked recording sheets has reached a limit amount in crease processing, a warning message is displayed and the output is temporarily stopped. This can prevent the creased portions by the creasing processing from being crashed due to a large number of stacked sheets, and prevent the output products from being separated to a plurality of discharge destinations and causing the operator's collection work to be troublesome.

A known stacker apparatus, as an example of the discharge apparatus, includes functions to eject current stacked products when the sheets are fully stacked on a stacking portion and continues the operation. When such a stacker apparatus is used, at a time when the stacked amount of the stacked recording sheets reaches a limit amount in crease processing, without immediately issuing the temporary stop of the output, the stacker apparatus can be configured to try ejection of the stacked products.

In the first and second exemplary embodiments, the apparatus can be configured to enable the operator to check on which discharge destination crease-processed sheets have been stacked. For example, when an apparatus configuration check menu screen (not illustrated) is opened from the operation unit 501, a dedicated message or an icon can be displayed at a portion indicating a discharge destination whose item 703 indicating whether a crease-processed sheet is stacked indicating "stacked".

A sheet discharge control relating to a print job in the image forming apparatus 301 according to a third exemplary embodiment is described. In the first and second exemplary embodiments, a sheet relating to a job is discharged to a discharge destination on which no crease-processed sheet is stacked, and at a time when the stacked sheet counter reaches a stack limit amount in crease processing during the job, the subsequent output is limited. In the present exemplary embodiment, to a discharge destination having a stack capacity exceeding a stack limit amount in crease processing, output of a print job to which a specification of turning on the crease processing has been made is not performed.

Figure 11:
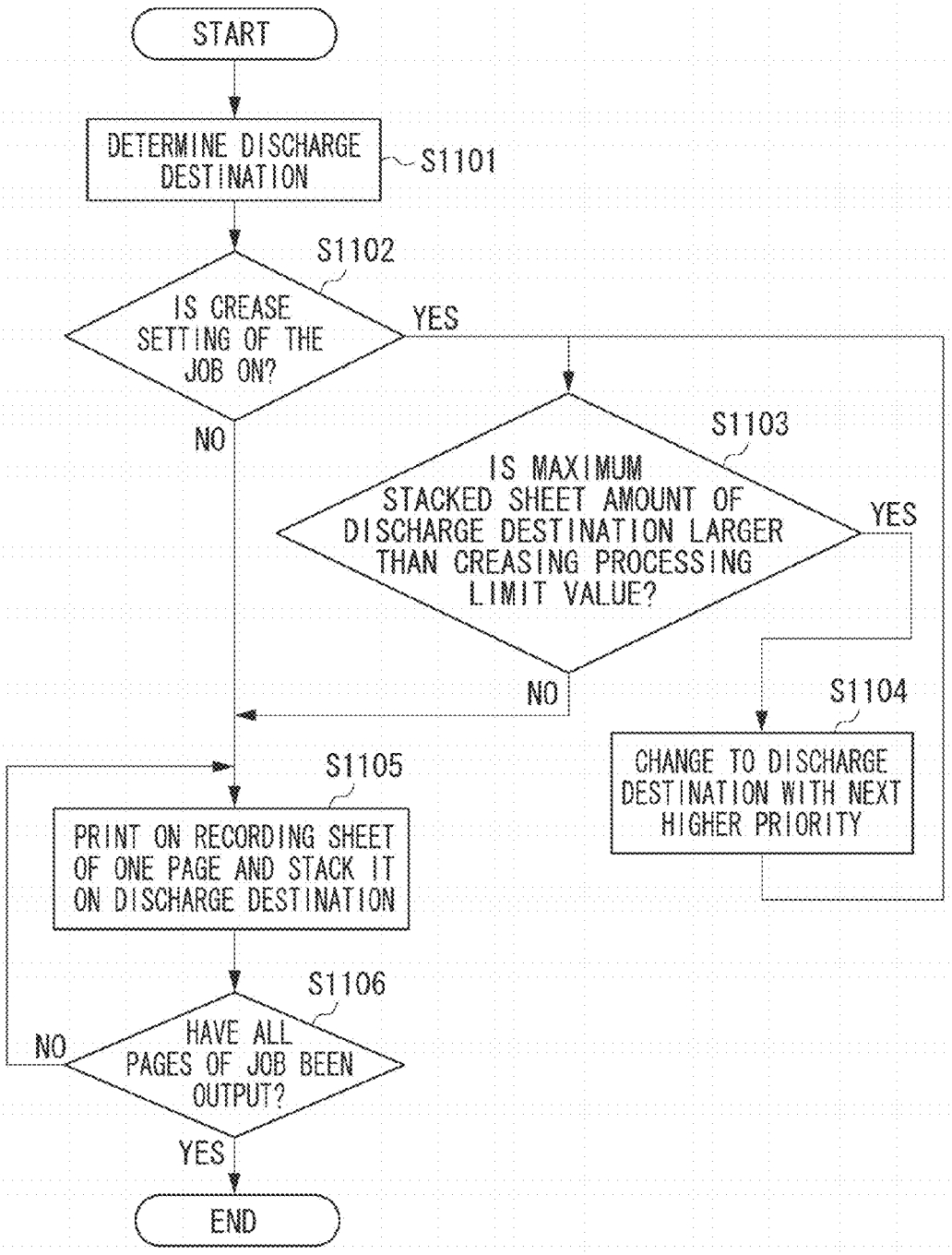
FIG. 11 is a flowchart illustrating a control method of a printing apparatus.

FIG. 11 is a flowchart illustrating an example of a method for controlling the printing apparatus according to the present exemplary embodiment. This example is an example of the sheet discharge control including sheet processing in the printing apparatus. Each step illustrated in FIG. 8 is implemented by the CPU 401 illustrated in FIG. 4 by reading the control program stored in the ROM 403 into the RAM 402 and executing the program. In the description below, the modules illustrated in FIG. 6 are used as main constituents.

In step S1101, after the start of a print job, the discharge control unit 605 determines a discharge destination of the recording paper for the print job. In step S1102, the discharge control unit 605 determines whether a specification of turning on the crease processing has been made to the job. If the discharge control unit 605 determines that a specification of turning on the crease processing has been made (YES in step S1102), the processing proceeds to step S1103. In step S1103, the discharge control unit 605 reads the maximum stackable sheet amount 701 of the discharge destination from the management table 700, and determines whether the maximum stackable sheet amount 701 is larger than a stack limit amount in crease processing.

If the discharge control unit 605 determines that the maximum stackable sheet amount 701 is larger than the stack limit amount in crease processing (YES in step S1103), then in step S1104, the discharge control unit 605 changes the discharge destination to a discharge destination with a next higher priority. Then, the processing returns to step S1103.

If the discharge control unit 605 determines that a specification of turning on the crease processing has not been made to the job (NO in step S1102), or the stacked sheet amount of the discharge destination is smaller than the stack limit amount in crease processing (NO in step S1103), the processing proceeds to step S1105. The processing in step S1105 is similar to that in step S905, and the processing in step S1106 is similar to that in step S911, and therefore descriptions thereof are omitted. With this step, the job to which the specification of turning on the crease setting is made is considered to be the print job for performing specific post-processing on the print product, and the output to the discharge destination having the stack capacity exceeding the stack limit amount in crease processing can be prevented. This means that the number of the stacked crease-processed sheets does not exceed the stack limit amount in crease processing, and the crash in the creased portions can be prevented.

While the exemplary embodiments of the present invention have been described with reference to the attached drawings, it is to be understood that specific configurations are not limited to these configurations, various modifications and addition can be made without departing from the scope of the invention.

Each step in the exemplary embodiments of the present invention can be implemented by executing software (program) acquired via a network or various storage media using a processing device (CPU or processor) such as a personal computer (computer).

It is to be understood that the present invention is not limited to the disclosed exemplary embodiments, various modifications (including organic combinations of the exemplary embodiments) can be made, and the modifications are not excluded from the scope of the invention.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-034454 filed Feb. 25, 2014, which is hereby incorporated by reference herein in its entirety.

What is claimed is:

1. A sheet processing apparatus comprising:

a processing unit configured to perform crease processing on a sheet;

a sheet discharge unit configured to discharge a sheet having been subjected to the crease processing by the processing unit;

a determination unit configured to determine whether a number of the discharged sheets having been subjected to the crease processing exceeds a predetermined number of sheets; and a control unit configured to perform control to cause the sheet discharge unit to discharge a sheet, wherein, in a case where the determination unit determines that the number of the discharged sheets having been subjected to the crease processing exceeds the predetermined number of sheets, the control unit performs control to cause the sheet discharge unit not to discharge sheets having been subjected to the crease processing onto the discharge destination.

2. The sheet processing apparatus according to claim 1, wherein, in a case where the determination unit determines that the number of the discharged sheets exceeds the predetermined number of sheets, the control unit performs control to stop discharging the sheets having been subjected to the crease processing.

3. The sheet processing apparatus according to claim 1, wherein, in a case where the determination unit determines that the number of the discharged sheets exceeds the predetermined number of sheets, the control unit performs control to change the discharge destination of the sheets having been subjected to the crease processing.

4. The sheet processing apparatus according to claim 1, wherein, in a case where the determination unit determines that the number of the discharged sheets exceeds the predetermined number of sheets, the control unit performs control to issue a notification of removing the sheets discharged onto the discharge destination.

5. A control method for controlling a sheet processing apparatus having a sheet discharge unit, the control method comprising:

performing crease processing on a sheet;

discharging, via the sheet discharge unit, a sheet having been subjected to the crease processing;

determining whether a number of the discharged sheets having been subjected to the crease processing exceeds a predetermined number of sheets; and performing control to cause the sheet discharge unit to discharge a sheet, wherein, in a case where it is determined that the number of the discharged sheets having been subjected to the crease processing exceeds the predetermined number of sheets, performing control includes causing the sheet discharge unit not to discharge sheets having been subjected to the crease processing onto the discharge destination.

6. A non-transitory storage medium storing a program to cause a computer to perform a control method for controlling a sheet processing apparatus having a sheet discharge unit, the control method comprising:

performing crease processing on a sheet;

discharging, via the sheet discharge unit, a sheet having been subjected to the crease processing;

determining whether a number of the discharged sheets having been subjected to the crease processing exceeds a predetermined number of sheets; and performing control to cause the sheet discharge unit to discharge a sheet, wherein, in a case where it is determined that the number of the discharged sheets having been subjected to the crease processing exceeds the predetermined number of sheets, performing control includes causing the sheet discharge unit not to discharge sheets having been subjected to the crease processing onto the discharge destination.

* * * * *